United States Patent [19]

DiBiasi et al.

[11] Patent Number: 4,842,420

[45] Date of Patent: Jun. 27, 1989

[54] VARIABLE-WIDTH DRAW TAPE FOR THERMOPLASTIC BAGS

[75] Inventors: Daniel J. DiBiasi, Pittsford; Fox J. Herrington, Holcomb, both of N.Y.

[73] Assignee: Mobil Oil Corporation, New York, N.Y.

[21] Appl. No.: 134,270

[22] Filed: Dec. 14, 1987

[51] Int. Cl.[4] ..... B65D 33/10; B65D 33/12; B65D 33/28

[52] U.S. Cl. ..... 383/6; 383/75

[58] Field of Search ..... 383/6, 8, 75

[56] References Cited

U.S. PATENT DOCUMENTS 3,029,853 4/1962 Piazzi .
3,506,048 4/1970 Jortikka .
4,165,832 8/1979 Kuklies et al. .
4,558,463 12/1985 Boyd .
4,597,750 7/1986 Boyd et al. .
4,617,008 10/1986 Boyd et al. .
4,624,654 11/1986 Boyd et al. .
4,628,536 12/1986 Herrington .

FOREIGN PATENT DOCUMENTS 1125363 8/1968 Japan .

*Primary Examiner*—Stephen P. Garbe
*Attorney, Agent, or Firm*—Alexander J. McKillop; Charles J. Speciale

[57] ABSTRACT

A draw tape for a bag where the draw tape is made wider at the center area where it is gripped by hand for forcing any elongation to occur at some other point thereby preventing "roping" at the hand area.

2 Claims, 1 Drawing Sheet

VARIABLE-WIDTH DRAW TAPE FOR THERMOPLASTIC BAGS

FIELD OF THE INVENTION

The present invention relates to thermoplastic draw tape handles inserted into thermoplastic bags, and in particular, to a tape configuration especially designed to reduce stress concentration, commonly known as "roping", at the hand area while the bag is under load.

BACKGROUND OF THE INVENTION

Bags made of thin polyethylene material have been used in various sizes. Small bags are used in packaging of sandwiches and the like. Larger bags are used as shopping bags. Even larger bags are used for containing trash.

A particularly advantageous closure for such a bag includes a draw tape made from the same polyethylene material as the bag. U.S. Pat. No. 3,029,853—Piazzi, British Pat. No. 1,125,363 Jortikka, U.S. Pat. No. 4,558,463—Boyd and U.S. Pat. No. 4,624,654—Boyd et al are examples of draw tape bags. Such closures have been successfully employed in these bags.

Draw tape closures for large trach bags, and the manufacture of these draw tape trash bags, are described in the aforesaid U.S. Pat. Nos. 4,558,463 and 4,624,654. Other related patents are U.S. Pat. No. 4,617,008—Boyd et al which describes a hem forming apparatus and U.S. Pat. No. 4,597,750—Boyd et al which describes the apparatus for inserting a draw tape into the bag. Bags having intermittently oriented draw tapes are disclosed in related U.S. Pat. No. 4,628,536—Herrington. The disclosures of the foregoing related patents are incorporated herein by reference.

In the past, thermoplastic bag structures with integral handle elements formed as an integral part of the bag structure itself have been produced by a method which reduces stress concentration. Stress points around the bag mouth are distributed to areas which are less likely to rupture as a result of stress concentration. See U.S. Pat. No. 4,165,832—Kuklies et al. This patent discloses a thermoplastic bag structure with integral handle elements, ie.e. the handles are actually an extension of the bag proper and stres relief notches positioned at opposite ends of the mouth.

Previous handle configurations for thermoplastic bags have been characterized by exhibiting the effect of "roping" while the bag is under load. According to the Kuklies et al patent, stress concentration causes a thermoplastic handle to form a rope while under load, such rope having a diameter given by the following formula:

$$D=(8\ WG/\pi)^{\frac{1}{2}}$$

where D is the equivalent diameter of the "rope" (in.), W is the width of the handle structure (in.), and G is the gauge (mils) of the handle structure.

A decrease in the gauge of the thermoplastic handle exhibiting the above characteristic would give a rope of a decreased diameter. A thermoplastic bag handle forming a rope of a smaller diameter will cause more discomfort to the carrier of such a bag, due to a decreased area of distribution of the weight of the bag upon the hand of the carrier.

Draw tape bags have a draw tape that is a separate structure from the bag proper. Draw tape trash bags of the type made according to the above-mentioned Boyd et al patents normally have a 1" wide draw tape for the full width of the bag. When the tape is pulled hard to close the bag, it elongates over most of its length, and the area where it is gripped by the hand becomes narrow, or "ropes" and hurts the hand. It is possible to make a draw tape that is sufficiently strong at thin gauges, such as 1.5 mils, but this tape is unsatisfactory for use because of the "roping" effect. As a result, it has been customary to use a tape material that is thicker, thus more costly then that which is required for performance. For example, tape thicknesses that have been used are in the order of 3 to 4 mils, about twice what is actually required.

It is desirable to produce a thermoplastic bag handle of a smaller gauge, less costly material, while substantially preventing "roping" at the area of the handle held by the hand of the carrier.

RELATED APPLICATION

"Ribbed Draw Tape for Thermoplastic Bag", Edward M. Bullard, Ser. No. 71,196, filed July 9, 1987 describes a draw tape for a trash bag having transverse or angular ribs which reduce roping of the draw tape when lifting a loaded bag. The disclosure of the foregoing application is incorporated herein by reference.

SUMMARY OF THE INVENTION

In accordance with the invention, a draw tape for a trash bag is made wider in the area where it is gripped by hand and narrower on both sides thereby causing an elongation to occur at some other point in the tape and thus preventing "roping" at the hand area when lifting a loaded bag. When the bag is drawn closed, the tape is pulled by gripping it at the wide portion. As the tape is stressed and yields, it becomes narrower. However, since the stress is greater where the tape is narrower, the elongation and the narrowing occurs at places other than where it is touching the hand. Thus the tape remains wide and does not cause discomfort to the hand.

Further in accordance with the invention, the tape is slit for a short length at the ends of each of the wide hand area. This avoids the concentration of the load of the elongating material adjacent to the wide region of the tape at the center of the tape width thereby minimizing the possibility of causing the wide region of the tape to collapse in width.

The foregoing and other objects, features and advantages of the invention will be more apparent from the following detailed description and appended claims.

SHORT DESCRIPTION OF THE DRAWINGS

DESCRIPTION OF THE PREFERRED EMBODIMENT

Figure 1:
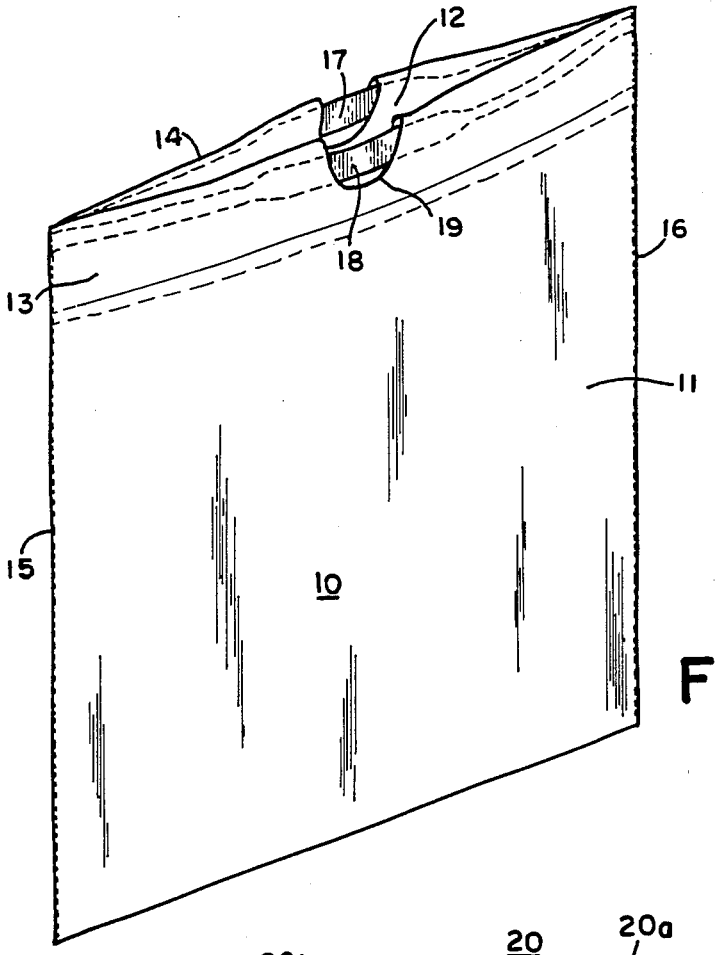
FIG. 1 shows a draw tape bag including a draw tape embodying the present invention.

As shown in FIG. 1, a draw tape bag 10 for carrying trash includes two panels 11 and 12. The two panels are formed from an extruded tube of polyethylene which is slit along the side to form an open top. The hems 13 and 14 of each panel are folded over adjacent the top and heat sealed horizontally. The sides of the panels 11 and 12 are heat sealed at 15 and 16 and cut from the tube in a perpendicular direction. Draw tapes 17 and 18 are inserted into the respective hems 13, 14 and secured by the heat seals 15 and 16 at the sides of the panels. A cut-out 19 in the hem of each panel at the middle of the bag, exposes the center section of the draw tapes 17 and 18 so that they can be grasped. When the bag 10 is loaded with trash, the draw tapes 17 and 18 are grasped at the center section and lifted, thereby closing mouth of the bag. The draw tapes 17 and 18 can thereafter be tied together to hold the bag closed.

Figure 2:
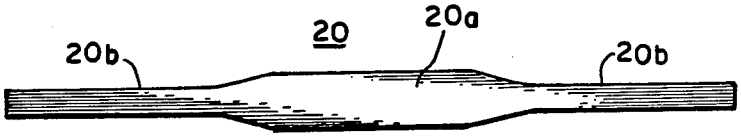
FIG. 2 shows a draw tape embodying the present invention.

Referring to FIG. 2 there is illustrated a draw tape 20 embodying the present invention. Both of the draw tapes 17 and 18 shown in FIG. 1 may be made in accordance with the construction of draw tape 20 in FIG. 2 now to be described. It will be noted that the draw tape 20 includes a wide center section 20*a* and two narrow side sections 20*b*, 20*b*. Thus the draw tape 20 has a uniform narrow width for most of its length but is wider at the center section 20*a*. The free ends of the side sections 20*b*, 20*b*, are secured to the sides of the panels 11 and 12, FIG. 1, when the heat seals 15 and 16 are made. By way of example, the side sections 20*b*, 20*b* have a width of about 3/4" while the center section 20*a* has a width of 1¼" for about an 8" length at the center of the bag. The length of the center section 20*a* is adequate for providing a hand grip for the tape 20. When the bag is drawn closed, the tape 20 is pulled by gripping it at the wide section 20*a*. As the tape is stressed and yields, it becomes narrower. However, since the stress is greater where the tape is narrower, at the side sections 20*b*, 20*b*, the elongation and the narrowing occurs in the section 20*b*, 20*b* rather than where the tape is gripped by the hand. Thus the center section 20*a* of the tape remains wide and does not cause discomfort to the hand.

Figure 3:
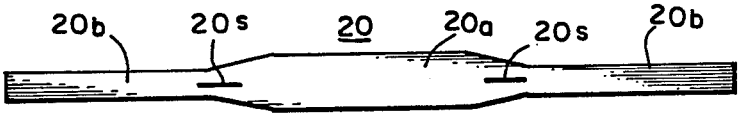
FIG. 3 shows a draw tape embodying the present invention.
Figure 4:
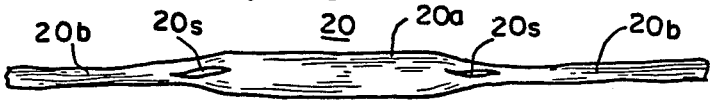
FIG. 4 shows a draw tape of the type shown in FIG. 3 but in stretched condition.

Referring to FIG. 3, the tape 20 of FIG. 2, has been modified to include two short slits 20*s*, 20*s*. The slits 20*s*, 20*s* are located at the opposite ends of the center section 20*a* and along the center line of the tape 20. The slits 20*s*, 20*s*, avoid the problem of the elongating material in the tape adjacent to the wide region 20*a* from concentrating its load in the center of the tape width, possibly causing the wide region 20*a* to collapse in width. This is illustrated in FIG. 4. In FIG. 4 it will be seen that the two slits 20*s*, 20*s* have prevented the elongating material adjacent the center section 20*a* from concentrating its load on the center line of the tape and has divided this load to the two narrow sections on the sides of the slits 20*s* thereby avoiding collapse of the center section 20*a*.

What is claimed is:

1. A draw tape bag for carrying trash and the like comprising:

two panels forming an open top, closed bottom bag, said panels being joined along the sides of said bag;

a hem on said panels being folded over adjacent said top, the bottom of said hem being secured to the adjacent panel;

a draw tape in each said hem secured at the side of said panels, each said draw tape comprising a center section and two side sections, said side sections having a width narrower than said center section, said center section having a length adequate to provide a hand grip for said tape whereby when said center section is gripped and pulled to draw closed the open top of the bag, the draw tape is stressed and yields becoming narrower, the stress being greater where the tape narrowers at the side sections whereby the elongation and narrowing occurs at the side sections rather than the center section where the hand grips the tape, and wherein each draw tape has slit structure at the ends of the center section adjoining the narrower side sections, said slit structure being located longitudinally of the tape whereby the elongating material adjacent the wide region of the center section concentrates its load on either side of the center of the tape thereby avoiding a collapse in width of the wide region of the tape.

2. A draw tape bag according to claim 1 wherein said slit structure is located in the center of the tape width.

* * * * *